US005953896A

United States Patent [19]

Stahlecker

[11] Patent Number: 5,953,896

[45] Date of Patent: Sep. 21, 1999

[54] ADAPTOR FOR AN OPEN-END SPINNING ARRANGEMENT AND METHOD OF MAKING SAME

[75] Inventor: Fritz Stahlecker, Bad Überkingen, Germany

[73] Assignees: Fritz Stahlecker, Bad Ueberkingen; Hans Stahlecker, Suessen, both of Germany

[21] Appl. No.: 09/064,195

[22] Filed: Apr. 22, 1998

[30] Foreign Application Priority Data

Jun. 12, 1997 [DE] Germany ..... 197 24 882

[51] Int. Cl.[6] ..... D01H 4/00

[52] U.S. Cl. ..... 57/404; 57/352; 57/406; 57/407; 57/408; 57/411; 57/413; 57/417

[58] Field of Search ..... 57/352, 404, 406, 57/407, 408, 411, 413, 417

[56] References Cited

U.S. PATENT DOCUMENTS 4,291,528 9/1981 Miyamoto et al. ..... 57/408
4,854,119 8/1989 Stahlecker et al. ..... 57/406
5,794,430 8/1998 Grecksch et al. ..... 57/404

FOREIGN PATENT DOCUMENTS

0654551B1 5/1995 European Pat. Off. .

*Primary Examiner*—William Stryjewski
*Attorney, Agent, or Firm*—Evenson McKeown Edwards & Lenahan PLLC

[57] ABSTRACT

An adaptor is provided for an open-end rotor spinning arrangement, which adaptor is exchangeably arranged on a cover element of a spinning rotor and projects partly into the inside of the spinning rotor. The adaptor comprises the first section of a yarn withdrawal channel, as well as the end section of a fiber feed channel. On its side facing away from the spinning rotor, the adaptor has a bearing surface in the form of a plane ring surface, which by means of an axially effective fixing device is drawn against a take-up surface of the cover element. The circumferential surface of the adaptor is in the form of a cylindrical surface. A centering element, for fixing the adaptor on the take-up surface at an exact angle, is arranged at the fixing device, which centering element is disposed, in relation to the yarn withdrawal channel, almost diametrically opposite to the fixing device.

47 Claims, 2 Drawing Sheets

ADAPTOR FOR AN OPEN-END SPINNING ARRANGEMENT AND METHOD OF MAKING SAME

BACKGROUND AND SUMMARY OF THE INVENTION

This application claims the priority of application 197 24 882.9, filed in Germany Jun. 12, 1997, the disclosure of which is expressly incorporated by reference herein.

The present invention relates to an adaptor for an open-end rotor spinning arrangement, which adaptor takes the form of an extension piece partly projecting into a cover element of a spinning rotor; the adaptor is exchangeable and adapted to the dimensions of the spinning rotor and is essentially rotationally symmetrical in shape. The adaptor comprises a centrical connecting channel which forms the first section of a yarn withdrawal channel. The adaptor also includes a traverse channel which forms the end section of a fiber feed channel, the entry opening of the traverse channel being located on a circumferential surface of the adapter and continuing a section of the fiber feed channel located in the cover element by means of a partition joint while the exit opening of the traverse channel projects into the spinning rotor. The adaptor also comprises a bearing surface located on the side of the adaptor facing away from the spinning rotor, which bearing surface is disposed, airtight, on a take-up surface of the cover element, against which the adaptor is disposable by means of at least one axially effective fixing device. The adaptor also comprises an eccentric centering element for fixing the adaptor to the take-up surface at an exact angle.

In the case of an adaptor of this type (European published patent 654 551), the bearing surface is conically formed and is drawn against the equally conically formed take-up surface by means of fixing elements. The bearing surface also comprises the partition joint, at which the part of the fiber feed channel located in the cover element is continued by the end section of the fiber feed channel located in the adaptor. It is extremely difficult, from the point of view of manufacturing, to make the conical surfaces, arranged to each other, to exactly the same degree of conicity. Even in the case of the smallest deviations in conicity or in the diameters, the end area of the fiber feed channel located in the adaptor and the section of the fiber feed channel located in the cover element are laterally out of line.

It is an object of the present invention to achieve an effective seal between the bearing surface of the adaptor and the take-up surface of the cover element using the simplest but nevertheless adequately exact production methods possible, without the end section of the fiber feed channel, located in the adaptor, being laterally out of line with the section of the fiber feed channel in the cover element.

This object has been achieved in accordance with the present invention in that the bearing surface takes the form of a plane ring surface, and in that the circumferential surface containing the partition joint is in the form of a cylindrical surface, and that only one fixing device is provided, and that the fixing device and the centering element are arranged—in relation to the yarn withdrawal channel—almost diametrically opposite each other.

Because the bearing surface takes the form of a plane ring surface, the manufacture of the bearing surface is on the one hand significantly easier than in prior art, and on the other hand more exact, in particular with regard to matching up with the arranged take-up surface. An airtight seal is obtained between the bearing surface and the take-up surface without any further intermediary sealing means being necessary. Because the circumferential surface takes the form of a cylindrical surface, a sufficiently exact production is also possible in this area, without the risk of there being a lateral misalignment inside the fiber feed channel at the partition joint. Because the centering element is arranged almost diametrically opposite to the fixing device a single fixing device is sufficient in practice, whereby an effective arrangement of the bearing surface of the adaptor on the take-up surface of the cover element is still obtained.

For the purpose of the present invention, the fixing device is provided in close proximity to the partition joint, so that the hold is particularly intensive at that point where sections of the fiber feed channel are disposed adjacently.

A location bore hole, arranged parallel to the yarn withdrawal channel, is advantageously arranged at the fixing device, which takes the form of a screw bolt, which location bore hole is provided with a thread-free entry opening. The location bore hole, parallel to the yarn withdrawal nozzle, ensures that between the adaptor and the take-up surface no misalignment takes place, because the thread-free entry opening for the screw bolt supports the bore hole in this action.

In certain preferred embodiments of the invention, the centering element comprises two centering ribs extending parallel to one another, which are arranged at a cylindrical guiding surface arranged at the cover element. Thus it is not so much a case of centering a setting plug into a bore hole, which would result in a relatively time-consuming assembly, but rather the guiding surface of a short pin needs only to be inserted between two ribs, whereby a considerable lateral clearance in longitudinal direction of the ribs is admissible. Only the distance between the ribs and the cylindrical guiding surface must be exactly right.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
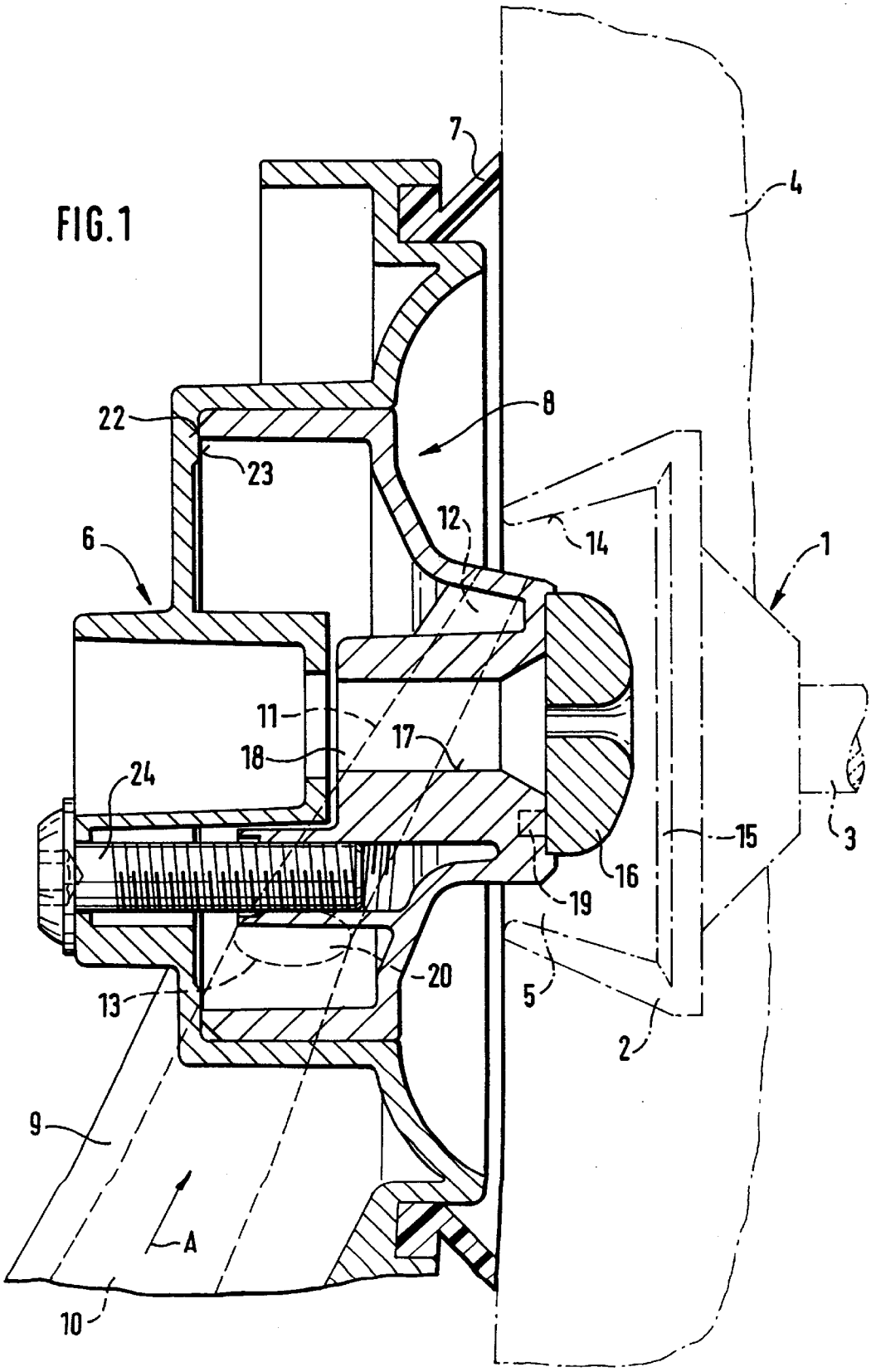
FIG. 1 is a part sectional side view of a cover element of a spinning rotor comprising an adaptor, constructed according to a preferred embodiment of the present invention.

In FIG. 1, a spinning rotor 1 of an open-end rotor spinning arrangement is denoted by dot-dash lines. It comprises in the known way a rotor cup 2 and a shaft 3, which is supported and driven in a way not shown here.

During operation, the rotor cup 2 rotates in the known way in a rotor housing 4 under a prevailing vacuum, which rotor housing 4 is denoted also by dot-dash lines. The open front side 5 of the rotor cup 2 is closed by a cover element 6 which can be selectively moved out of the way for maintenance purposes. A sealing ring 7 ensures that between the cover element 6 and the rotor housing 4 there is an airtight seal.

An essentially rotationally symmetrical adaptor 8 is arranged on the cover element 6 in the form of an exchangeable extension piece, which adaptor 8 projects partly into the inside of the rotor cup 2. A section 9 of a fiber feed channel 10 is arranged in this cover element 6, which channel 10 extends from an opening roller (not shown) to the rotor cup 2. The fiber transport direction is denoted by A. The fiber transport itself occurs in a known way with the aid of the applied vacuum.

The end section 11 of the fiber feed channel 10 facing the rotor cup 2 is arranged in the adaptor 8. Its exit opening 12 projects into the inside of the rotor cup 2. The entry opening 20 of the end area 11 of the fiber feed channel 10 located on the cylindrical circumferential surface 21 of the adaptor 8 is disposed adjacent to the section 9 of the fiber feed channel 10 located outside of the adaptor 8 by means of the partition joint 13, so that the end section 11 of the fiber feed channel 10 takes the form of a traverse channel. The graduation at the partition joint 13 between the section 9 and the end area 11 of the fiber feed channel 10 is such that the initial cross section of the end area 11 overlaps the end cross section of the section 9.

The exit opening 12 of the fiber feed channel 10 is disposed at a short distance opposite a fiber sliding surface 14 of the rotor cup 2. The fiber sliding surface 14 widens conically, from the open front side 5 of the rotor cup 2 towards a fiber collecting groove 15, to where the fibers fed to the fiber sliding surface 14 slide in a known way and where they gather to form a fiber ring. The yarn formed in the fiber collecting groove 15 is withdrawn in a known way by means of a yarn withdrawal nozzle 16, which is arranged coaxially to the shaft 3 of the spinning rotor 1 at the adaptor 8. Besides the end section 11 of the fiber feed channel 10, the adaptor 8 comprises thus the starting section 17 of a yarn withdrawal channel 18, which takes the form of a through channel. The yarn withdrawal nozzle 16 itself is held by means of a plurality of permanent magnets 19 to the adaptor 8.

As detailed above, the adaptor 8 takes the form of an exchangeable extension piece of the cover element 6. The purpose of the exchangeability of the adaptor 8 is to permit the end area 11 of the fiber feed channel 10 to be adapted to various fiber materials and to different dimensions of the rotor cup 2 of the spinning rotor 1. In particular, adaptation to various diameters of the rotor cup 2 is provided. Thus, inadequate compromises with regard to the fiber feed are thus omitted in favor of good yarn quality.

Figure 2:
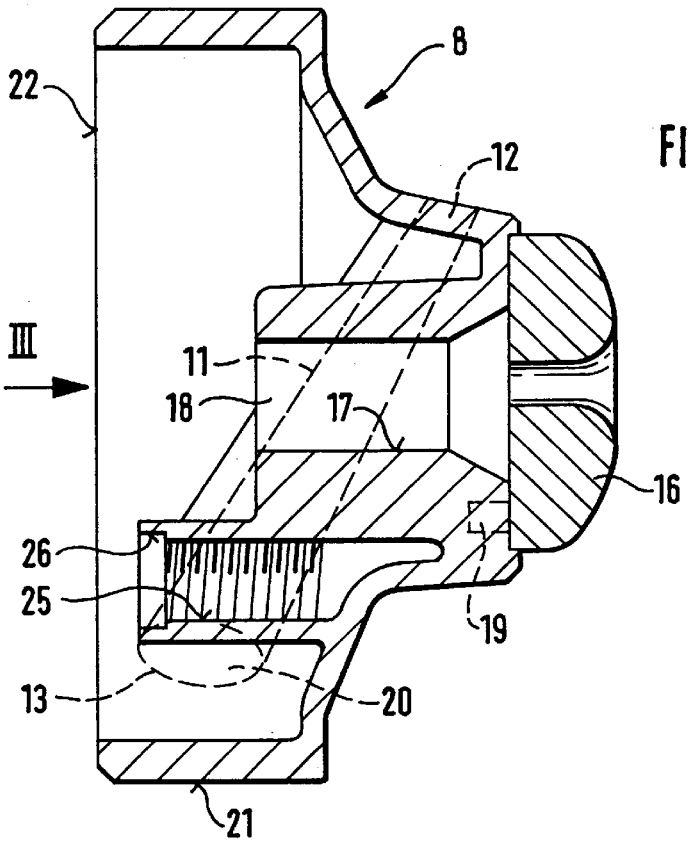
FIG. 2 is a sectional view of the adaptor itself only as shown in FIG. 1.
Figure 3:
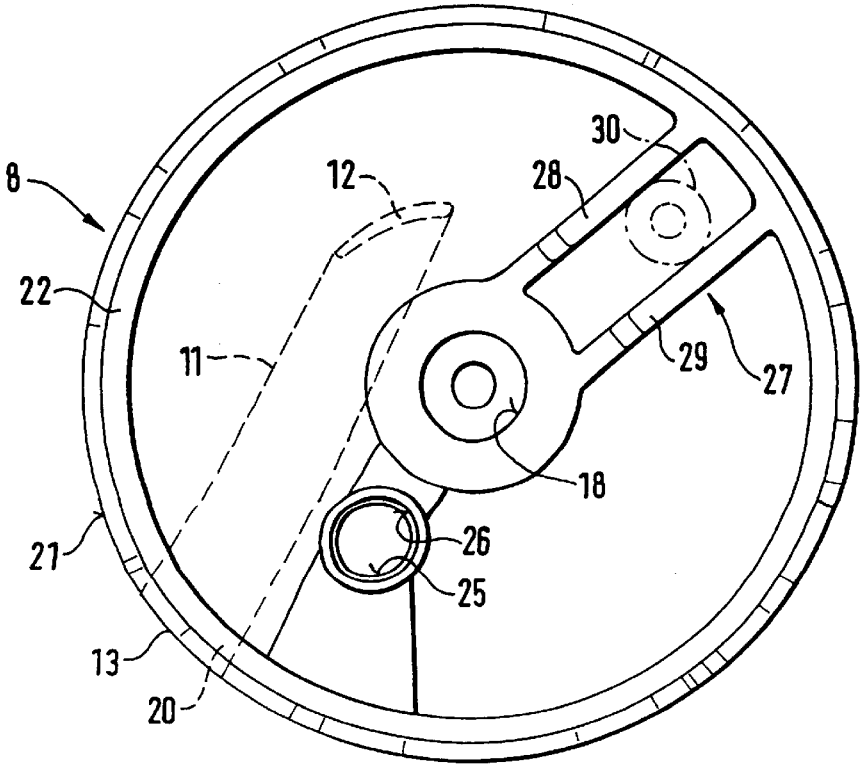
FIG. 3 is a view taken in the direction of the arrow III of the adaptor of FIG. 2.

With regard to FIGS. 2 and 3, it can be seen that on the side of the adaptor 8 facing away from the spinning rotor 1 a plane ring surface is provided, which serves as a bearing surface 22 of the adaptor 8 on a take-up surface 23 of the cover element 6. The take-up surface 23 comprises here also a plane ring surface arranged at the bearing surface 22. Thus an airtight seal is achieved between the adaptor 8 and the cover element 6.

The bearing force is generated by a single axially effective fixing device 24 in the form of a screw bolt, which is located in close proximity to the partition joint 13. The screw bolt is screwed into a location bore hole 25 of the adaptor 8 arranged parallel to the yarn withdrawal channel 18. In order to avoid any misalignment, the location bore hole 25 has a thread-free entry opening 26.

By means of the plane ring surface, not only is an airtight seal achieved, but also due to the avoidance of the conicity of the adaptor known in prior art, any form of misalignment is avoided inside the fiber feed channel 10 in the area of the partition joint 13. Prevention of misalignment is supported by a circumferential surface 21 of the adaptor 8, which surface 21 takes the form of a cylindrical surface.

Two centering ribs 28 and 29 are provided as eccentric centering elements 27 for fixing the adaptor 8 at an exact angle to the cover element 6, which centering ribs 28 and 29 are arranged—in relation to the yarn withdrawal channel 18—almost diametrically to the fixing device 24. The distance between the centering ribs 28 and 29 is such that a cylindrical guiding surface 30 of the cover element 6 can be arranged in an exact fit thereto. In FIG. 3, the guiding surface 30 is denoted only by a dot-dash line, as said guiding surface 30 is not, in this respect, visible.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An adaptor for an open-end rotor spinning arrangement, said adaptor being exchangeable, adapted to the dimensions of a spinning rotor and essentially rotationally symmetrical in shape, while taking the form of an extension piece capable of being fixed to a cover element of the spinning rotor and projecting partly thereinto, said adaptor comprising:

a centrical through channel which forms a starting section of a yarn withdrawal channel, a traverse channel which forms an end section of a fiber feed channel, the entry opening of said traverse channel being located on a circumferential surface of the adaptor and which continues a section of the fiber feed channel located in the cover element by means of a partition joint, and the exit opening of said traverse channel projecting into the spinning rotor, a bearing surface located on a side of the adaptor facing away from the spinning rotor for the purpose of providing an airtight seal on a take-up surface of the cover element, an eccentric centering element for fixing the adaptor on the take-up surface at an exact angle, and a fixing device operable to detachably attach the adaptor to the cover element, wherein the bearing surface takes the form of a plane ring surface, wherein the circumferential surface containing the partition joint takes the form of a cylindrical surface, and wherein the fixing device and the centering element are disposed almost diametrically opposite one another with respect to the yarn withdrawal channel.

2. An adaptor according to claim 1, wherein the fixing device is provided in close proximity to the partition joint.

3. An adaptor according to claim 2, wherein a location bore hole disposed parallel to the yarn withdrawal channel is arranged for the fixing device which takes the form of a screw bolt, which location bore hole begins with a threadfree entry opening.

4. An adaptor according to claim 3, wherein the centering element comprises two centering ribs which extend parallel to one another, and which are arranged for centering engagement with a cylindrical guiding surface applied to the cover element.

5. An adaptor according to claim 2, wherein the centering element comprises two centering ribs which extend parallel to one another, and which are arranged for centering engagement with a cylindrical guiding surface applied to the cover element.

6. An adaptor according to claim 1, wherein a location bore hole disposed parallel to the yarn withdrawal channel is arranged for the fixing device which takes the form of a screw bolt, which location bore hole begins with a threadfree entry opening.

7. An adaptor according to claim 6, wherein the centering element comprises two centering ribs which extend parallel to one another, and which are arranged for centering engagement with a cylindrical guiding surface applied to the cover element.

8. An adaptor according to claim 1, wherein the centering element comprises two centering ribs which extend parallel to one another, and which are arranged for centering engagement with a cylindrical guiding surface applied to the cover element.

9. An exchangeable one-piece adaptor for an open-end rotor spinning assembly comprising:

an adaptor fiber feed channel which in use continues from a cover fiber feed channel in a cover supporting the adaptor, said adaptor fiber feed channel opening in use into a spinning rotor open side, portions of a yarn draw off channel, a planar sealing surface engageable in use with a planar sealing surface of the cover supporting the adaptor, and centering structure separate from said sealing surface to facilitate centering and circumferential positioning of the adaptor at the cover to assure alignment of the adaptor fiber feed channel with the cover fiber feed channel.

10. An adaptor according to claim 9, wherein the centering structure includes an eccentric centering element on the adaptor, said eccentric centering element being engageable with counter centering surfaces of the cover when in an in use assembled position on the cover.

11. An adaptor assembly according to claim 10, wherein the centering element includes two spaced parallel ribs which in use engage opposite diametric sides of a guide protrusion on the cover.

12. An exchangeable one-piece adaptor according to claim 9, wherein said adaptor includes an axially extending through hole for accommodating a fixing device for clamping the adaptor to the cover.

13. An exchangeable one-piece adaptor according to claim 12, wherein the portions of a yarn draw off channel are located in the center part of the adaptor.

14. An exchangeable one-piece adaptor according to claim 13, wherein the through hole is disposed parallel to and spaced from the portions of a yarn draw off channel.

15. An exchangeable one-piece adaptor according to claim 14, wherein said planar sealing surface is a circular annular surface.

16. An exchangeable one-piece adaptor according to claim 12, wherein said planar sealing surface is a circular annular surface.

17. An exchangeable one-piece adaptor according to claim 12, wherein the through hole includes a thread free entry opening for a threaded fixing device, and a threaded section adjacent the thread free entry opening.

18. An exchangeable one-piece adaptor according to claim 12, wherein an end of said adaptor feed channel which in use faces the cover is disposed in close proximity to the through hole and spaced from the centering structure.

19. An exchangeable one-piece adaptor according to claim 9, wherein the portions of a yarn draw off channel are located in the center part of the adaptor, and wherein the centering structure is spaced from the portions of a yarn draw off channel.

20. An exchangeable one-piece adaptor according to claim 19, wherein the centering structure includes a pair of centering ribs operable to engage opposite sides of centering structure on the cover when in an in-use position.

21. An exchangeable one-piece adaptor according to claim 19, wherein said adaptor includes an axially extending through hole for accommodating a fixing device for clamping the adaptor to the cover.

22. An exchangeable one-piece adaptor according to claim 9, wherein said centering ribs and said through hole are disposed at diametrically opposite sides of the center part of the adaptor.

23. An exchangeable one-piece adaptor according to claim 22, wherein an end of said adaptor feed channel which in use faces the cover is disposed closer to the through hole than to the centering ribs.

24. An exchangeable one-piece adaptor according to claim 23, wherein said planar sealing surface is a circular annular surface.

25. An exchangeable one-piece adaptor according to claim 9, wherein said planar sealing surface is a circular annular surface.

26. A method of making an exchangeable one-piece adaptor for an open-end rotor spinning assembly comprising:

providing a one-piece adaptor member, forming an adaptor fiber feed channel in the adaptor member which in use continues from a cover fiber feed channel in a cover supporting the adaptor member, said adaptor fiber feed channel opening in use into a spinning rotor open side, forming portions of a yarn draw off channel in the adaptor member, forming a planar sealing surface on the adaptor member which is engageable in use with a planar sealing surface of the cover supporting the adaptor member, and forming centering structure on the adaptor member separate from said sealing surface to facilitate centering and circumferential positioning of the adaptor member at the cover to assure alignment of the adaptor fiber feed channel with the cover fiber feed channel.

27. A method according to claim 26, wherein said adaptor member includes an axially extending through hole for accommodating a fixing device for clamping the adaptor member to the cover.

28. A method according to claim 27, wherein the portions of the yarn draw off channel are located in a center part of the adaptor member.

29. A method according to claim 28, wherein the through hole is disposed parallel to and spaced from the portions of a yarn draw off channel.

30. A method according to claim 29, wherein said planar sealing surface is a circular annular surface.

31. A method according to claim 27, wherein said planar sealing surface is a circular annular surface.

32. A method according to claim 27, wherein the through hole includes a thread free entry opening for a threaded fixing device, and a threaded section adjacent the thread free entry opening.

33. A method according to claim 26, wherein said adaptor member includes an axially extending through hole for accommodating a fixing device for clamping the adaptor member to the cover, and wherein the centering structure is spaced from the portions of a yarn draw off channel.

34. A method according to claim 33, wherein the centering structure includes a pair of centering ribs operable to engage opposite sides of centering structure on the cover when in an in-use position.

35. A method according to claim 16, wherein said planar sealing surface is a circular annular surface.

36. A method according to claim 33, wherein said adaptor includes an axially extending through hole for accommodating a fixing device for clamping the adaptor to the cover.

37. A method according to claim 36, wherein said centering ribs and said through hole are disposed at diametrically opposite sides of the center part of the adaptor member.

38. A method according to claim 37, wherein an end of said adaptor feed channel which in use faces the cover is disposed closer to the through hole than to the centering ribs.

39. A method according to claim 38, wherein said planar sealing surface is a circular annular surface.

40. A method according to claim 26, wherein an end of said adaptor feed channel which in use faces the cover is disposed in close proximity to the through hole and spaced from the centering structure.

41. A cover assembly for an open-end rotor spinning machine comprising:

a cover, a one-piece adaptor, and a fixing device for detachably fixing the adaptor to the cover, wherein said one-piece adaptor includes:

an adaptor fiber feed channel which in use continues from a cover feed channel in a cover supporting the adaptor, said adaptor fiber feed channel opening in use into a spinning rotor open side, portions of a yarn draw off channel, a planar sealing surface engageable in use with a planar sealing surface of the cover supporting the adaptor, centering structure separate from said sealing surface to facilitate centering and circumferential positioning of the adaptor at the cover to assure alignment of the adaptor fiber feed channel and the cover fiber feed channel, and a through hole spaced from the centering structure for accommodating the fixing device.

42. A cover assembly according to claim 41, wherein the portions of a yarn draw off channel are located in the center part of the adaptor, and wherein the through hole is disposed parallel to and spaced from the portions of a yarn draw off channel.

43. A cover assembly according to claim 42, wherein said planar sealing surface is a circular annular surface.

44. A cover assembly according to claim 41, wherein the centering structure includes a pair of centering ribs operable to engage opposite sides of centering structure on the cover when in an in-use position.

45. A cover assembly according to claim 44, wherein said centering ribs and said through hole are disposed at diametrically opposite sides of the center part of the adaptor.

46. A cover assembly according to claim 41, wherein said planar sealing surface is a circular annular surface.

47. A cover assembly according to claim 41, wherein the through hole includes a thread free entry opening for a threaded fixing device, and a threaded section adjacent the thread free entry opening.

* * * * *